US007967471B2

(12) United States Patent
Brune et al.

(10) Patent No.: US 7,967,471 B2
(45) Date of Patent: Jun. 28, 2011

(54) LIGHTING UNIT FOR WATER FOUNTAINS, PONDS OR THE LIKE

(75) Inventors: Dominik Brune, Ostbevern (DE); Reinhard Wesselmeier, Hörstel-Riesenbeck (DE)

(73) Assignee: OASE GmbH, Hörstel-Riesenbeck (DE)

( * ) Notice: Subject to any disclaimer, the term of this patent is extended or adjusted under 35 U.S.C. 154(b) by 135 days.

(21) Appl. No.: 12/051,239

(22) Filed: Mar. 19, 2008

(65) Prior Publication Data

US 2008/0232106 A1 Sep. 25, 2008

(30) Foreign Application Priority Data

Mar. 23, 2007 (DE) ..... 20 2007 004 480 U

(51) Int. Cl.
*F21V 31/00* (2006.01)
*F21V 5/04* (2006.01)
*F21V 17/00* (2006.01)

(52) U.S. Cl. ..... 362/267; 362/331; 362/375; 362/455

(58) Field of Classification Search ..... 362/267, 362/202–208, 158, 231, 331, 375, 455, 96, 362/101, 327
See application file for complete search history.

(56) References Cited

U.S. PATENT DOCUMENTS

| | | | | |
|---|---|---|---|---|
| 3,020,396 | A * | 2/1962 | Worboys | 362/331 |
| 3,209,138 | A * | 9/1965 | Moore et al. | 362/158 |
| 4,433,366 | A * | 2/1984 | Wade | 362/267 |
| 5,016,151 | A * | 5/1991 | Mula | 362/267 |
| 5,545,952 | A * | 8/1996 | Mortensen | 315/74 |
| 6,053,623 | A * | 4/2000 | Jones et al. | 362/310 |
| 6,819,506 | B1 * | 11/2004 | Taylor et al. | 362/327 |
| 7,004,600 | B2 * | 2/2006 | Echterling | 362/202 |
| 7,125,146 | B2 * | 10/2006 | Willis et al. | 362/267 |
| 7,874,714 | B2 * | 1/2011 | Yoneda et al. | 362/327 |
| 2005/0122713 | A1 * | 6/2005 | Hutchins | 362/205 |
| 2007/0109775 | A1 * | 5/2007 | Chen | 362/187 |
| 2007/0133200 | A1 * | 6/2007 | Uke et al. | 362/202 |
| 2009/0251893 | A1 * | 10/2009 | Shiao | 362/205 |

FOREIGN PATENT DOCUMENTS

DE 10321992 A1 3/2005

* cited by examiner

*Primary Examiner* — Alan Cariaso
(74) *Attorney, Agent, or Firm* — Gudrun E. Huckett

(57) ABSTRACT

A lighting unit for water fountains, ponds and the like, has a housing that is sealed at least relative to splashing water. A light source is arranged in the housing. A lens is arranged in the housing for alignment of light emitted by the light source. An additional lens unit is arranged in a light path of the light emitted by the light source for providing an additional alignment of the light emitted by the light source. A closure cap secures the additional lens unit by a self-centering action on the housing. The closure cap has an inner guide providing the self-centering action.

15 Claims, 2 Drawing Sheets

LIGHTING UNIT FOR WATER FOUNTAINS, PONDS OR THE LIKE

BACKGROUND OF THE INVENTION

The present invention concerns a lighting unit for water fountains, ponds or the like, comprising at least one housing that is sealed with regard to splashing water and that is provided with a light source and a lens for aligning the light emitted by the light source.

Lighting units according to the aforementioned prior art often do not provide a precisely aligned beam orientation required for a complex water fountain or a pond that is to be illuminated in a complex way. The beam paths that are emitted by conventional lighting units are often diffuse and have scattered light and other radiation that is emitted too far laterally relative to the lighting unit. In devices in which a clear water jet is ejected across distances of, for example, up to 15 meters, a highly precise alignment of the beam path is required.

It is therefore the object of the present invention to provide such an underwater lighting unit or a lighting unit for water fountains with which the beam path of emitted light can be aligned better.

SUMMARY OF THE INVENTION

The object is solved for a lighting unit of the aforementioned kind in that the lighting unit has an additional lens unit that is secured by means of a closure cap in a self-centering way for providing an additional alignment of the light.

By securing the additional lighting unit with a closure cap in a self-centering way, an additional alignment of the light emitted by the light source is effected. The self-centering action of the lens unit by means of the closure cap leads to a precise fixation of the additional lens unit that is realized automatically when closing the lighting unit. This has the effect of a precise alignment of the beam path and fulfills thus the requirements even in the case of water or liquid jets to be conveyed across large distances by the water fountain. Moreover, the self-centering action of the additional lens unit is advantageous for expanding and retrofitting already existing lighting units because the lens unit can be integrated into already existing lighting units. The closure cap that is designed especially for the additional lens unit thus forms an optimal retrofitting kit for already existing lighting units.

Advantageously, the lens unit is designed as an additional lens so that already existing lenses can be employed. Only the closure cap must be designed appropriately in such an embodiment.

Especially advantageous is the use of a thin lens whose refractive properties can optimally focus or align the beam path of the light emitted by the lighting unit.

The self-centering action that can be also assisted advantageously by an additional sealing ring can be realized by a guide that is in the form of a contact surface tapering along the optical axis of the lighting unit in the direction toward it. Such a slantedly oriented surface can be produced easily and can contribute in a simple way to an excellent alignment of the beam paths.

It is within the scope of the present invention to provide the lens unit with a contact surface that is embodied complementary to the contact area of the closure cap so that the lens will not be damaged when applying corresponding pressures.

The use of an additional lens unit has moreover the advantage that when utilizing a multi-color light source, preferably at two-color, three-color, or multi-color LED, the lens materials of the lens unit and the lens of the lighting unit can be matched to one another such that the beam path is essentially identical for each color.

A seal moreover can protect the housing with regard to splashing water or prevent penetration of water in case of underwater use of the units.

BRIEF DESCRIPTION OF THE DRAWINGS

Further advantages and details of the invention can be taken from the additional dependent claims as well as the following description of the schematic illustrations in the Figures. It is shown in:

DESCRIPTION OF PREFERRED EMBODIMENTS

Figure 1:
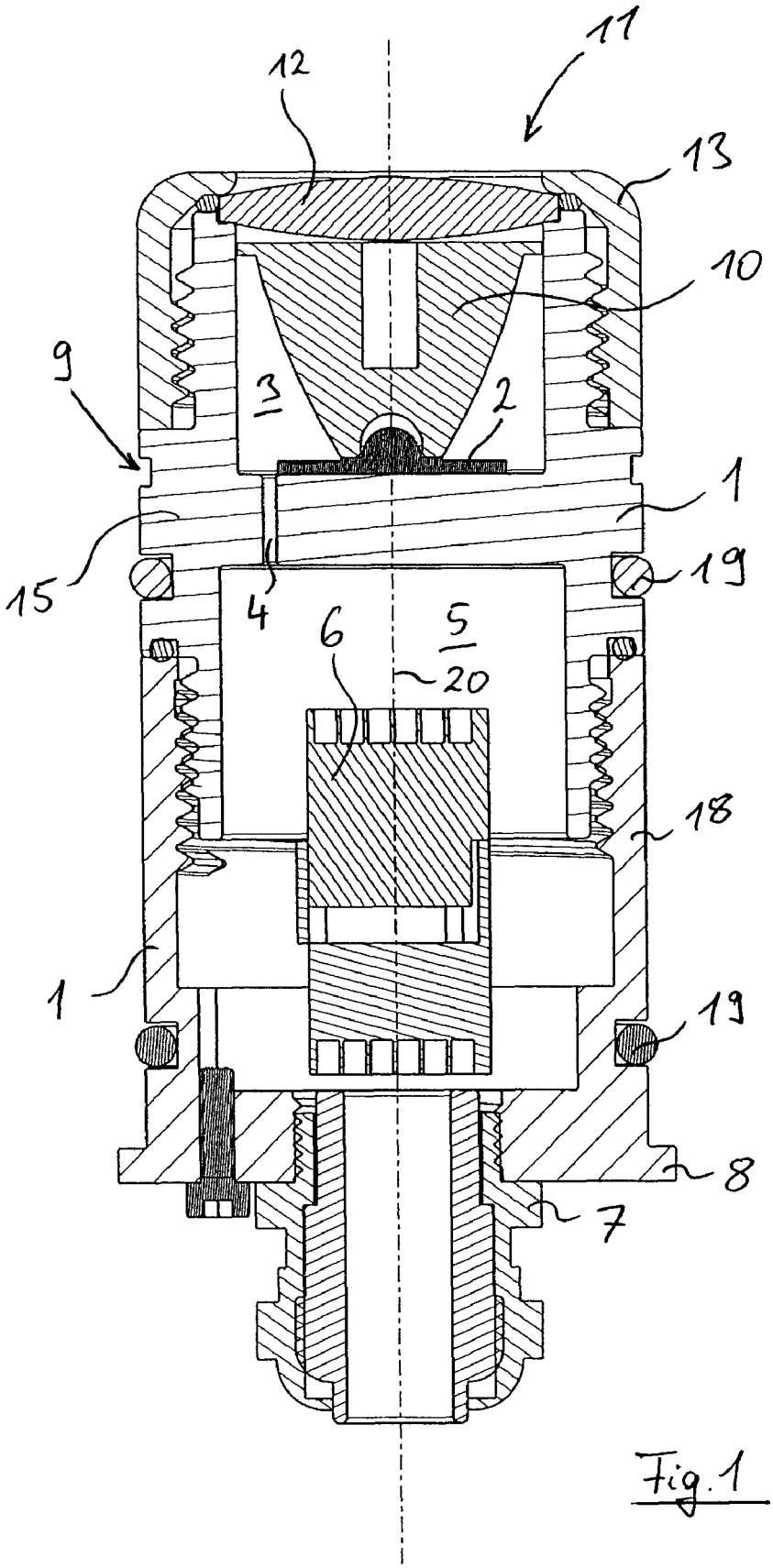
FIG. 1 a longitudinal section of the lighting unit according to the invention.

FIG. 1 shows a lighting unit for water fountains, ponds, or the like whose housing 1 is not only sealed with regard to splashing water but also can be employed in a complete underwater application for a water fountain, a pond or the like. In this embodiment according to the invention, in the housing 1 a light source in the form of a three-color LED is provided in an upper area of the housing 1 in a lighting chamber 3. By means of a cable guide 4 that is matched precisely to the thickness of the cable, the LED can be supplied with the required electric current.

The multi-color LED as light source 2 has several advantages. For example, the multi-color LED can be supplied with electric current by 12 volt voltage. Moreover, it has minimal energy consumption in comparison to other lighting means and has in general a service life that surpasses the functional life of the further parts of the lighting unit. The multi-color embodiment of the LED enables improved operation of complex light displays as a result of the greater variation possibilities. A control unit that is optionally required for this purpose can be provided external to the lighting unit at a central location. The control unit can also be arranged in a cavity 5 of the lighting unit and can be controlled by a control signal.

In the cavity 5 a plug 6 is arranged on the inner side of the lighting unit; by means of the plug the electric current supply of the light source 2 within the housing 1 is effected. The internal plug is thus protected and is subject to reduced wear in comparison to a plug arranged on the exterior.

The low-voltage current supply of 12 volt that, with regard to approval of the lighting unit, has advantages not only for gardens and ponds is realized by a cable screw connection 7 attachable externally to the housing 1. The latter is provided at the end of the housing 1 opposite the light source 2 at the end face of the housing 1. This arrangement is advantageous for mounting a lighting unit in a water fountain because the lighting unit can be inserted from below into a pressurized container of a water fountain producing a clear water jet. A flange 8 that extends circumferentially about the advantageously cylindrical housing 1 can be provided as an abutment.

A groove 9 circumferentially extending about the housing is advantageously provided to protect the lighting unit from slipping out or being pressed out of the water fountain; into the groove a spring ring or another fastening means can be inserted for securing the lighting unit.

In the lighting chamber 3 a lens 10 is arranged that directs the light emitted by the LED in the direction of the exit opening 11 of the housing 1. Despite its complex configuration this lens 10 is not able by itself to effect an orientation of the emitted light that is satisfactory for a highly complex water display. It is therefore provided according to the invention to arrange an additional lens unit 12 for additional alignment of the emitted light in or on the lighting unit. Because of the need for retrofitting already existing lighting units or because of the requirement with respect to parallel orientation or focusing of the light beams emitted by the lighting unit, the lens unit 12 must be secured precisely within the lighting unit. According to the invention, the lens unit 12 is secured by means of a closure cap 13 in a self-centering way in the lighting unit. In this way, a precise alignment of the optical axes 20 of the lens unit 12 and the lens 10 is effected. The two optical axes 20 should be congruent to one another.

Figure 2:
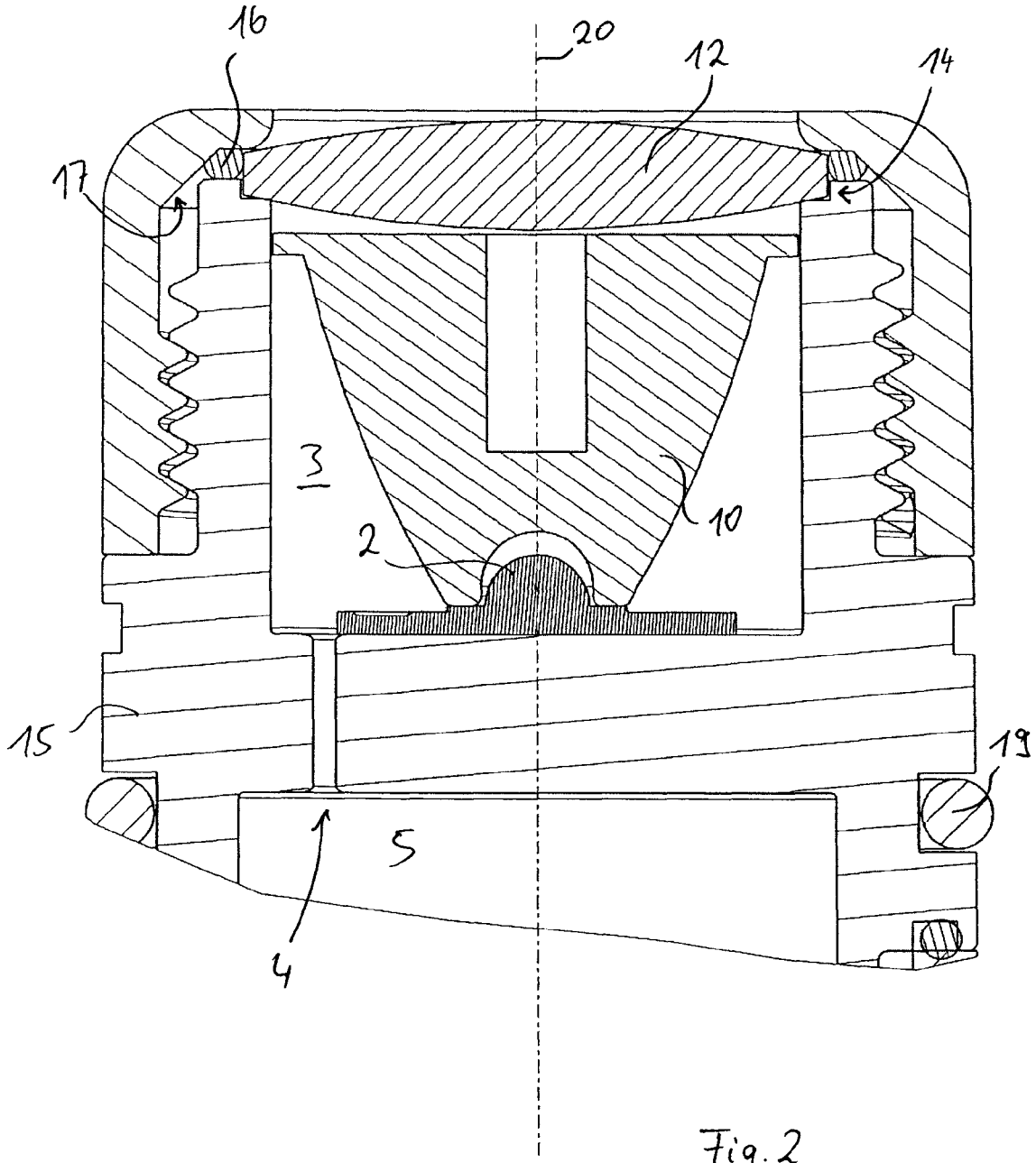
FIG. 2 a detail view of the lighting unit of FIG. 1 in accordance with the invention in a broken-away longitudinal section view.

In the embodiment according to FIGS. 1 and 2 the arrangement of the lens unit in the housing 1 is assisted by the insertion area 14 in the upper end of the central housing part 15. As can be seen in particular in FIG. 2, as a result of minimal movability of the lens it would be possible that displacements occur if the lens were not secured in a self-centering fashion by means of the closure cap 13.

The emitted light is advantageously first focused and/or aligned by the lens 10 and subsequently again by the lens unit 12 that is arranged downstream within the light path of the lens 10. The differently colored light beams can also be optimally aligned by this combination of lens 10 and lens unit 12.

According to the invention, it is provided to design the additional lens unit 12 as a preferably thin lens so that the corresponding laws of refraction apply and the calculation of the lens refraction is simplified.

Should an exact parallel beam path outside of the lighting unit be desired, the focal length of the additional lens unit 12 can be selected such that the light passing through the lens 10 is emitted by light source 2 that is positioned at a spacing to the lens unit 12 which spacing matches the focal length of the lens unit 12. Should it be desired to focus the beam emitted by the lighting unit more strongly, further arrangements of lens and lens unit, depending on the desired alignment, are conceivable.

Centering of the lens unit 12 is realized in both illustrations of the embodiment by a combination of a seal 16, serving at the same time as a seal for the housing 1, with an inner guide for the closure cap 13. This inner guide is formed in particular by a surface 17 that, when viewed in the direction of the optical axis 20 of the lighting unit, tapers toward this axis 20. The interior of the closure cap 13 thus tapers in the plane of the Figure, for example, FIG. 2, in the upward direction. On the one hand, this provides a self-centering action; on the other hand, the lens unit 12 can be secured essentially in a way so as not to be damaged.

In the illustrated embodiment, the closure cap 13 above the lens unit 12 presses directly onto the lens unit 12. The contact is realized only after centering of the lens has been completed and this without a relative lateral movement of the lens. The lens can thus be secured in a way so as not to be damaged.

Preferably the lens unit 12 can have a contact area complementary to the surface 17 in order to further simplify the centering action.

The lens 10 is usually fitted within the housing 15. However, it can also be positionally secured in its seat by the closure cap 13 and the lens unit 12. Correspondingly, after opening the housing 1, in the illustrated embodiment after unscrewing the closure cap, it can be removed from the housing 1 for maintenance and replacement purposes. For retrofitting and exchanging known lighting units, the closure cap and the lens with regard to their cross-section are not wider than the remainder of the housing 1 so that existing constructions that do not yet have such a covering cap are replaceable.

The guide surfaces of a water fountain usually allow some play between the wall of the housing 1 and the guide so that it is advantageous to provide additional centering of the housing or of the lighting unit in the guide of the water fountain. This is advantageously realized, i.e., in a particularly cost-beneficial and simply mountable way, in that two O-rings 19 are provided in recesses of the housing wall of the central housing part 15 and of the lower housing part 18.

For improving assembly and replacement of the lighting unit, the housing is of a three-part configuration so that, on the one hand, the electric contacts in the cavity 5 and, on the other hand, the light source and the means to be used with it for affecting the beam path are individually accessible in a further housing area.

The use of a visually pleasing cylindrical housing 1 effects in addition to the aesthetically pleasing effect also a shape that is advantageous for the centering action of the light beam.

The specification incorporates by reference the entire disclosure of German priority document 20 2007 004 480.1 having a filing date of Mar. 23, 2007.

While specific embodiments of the invention have been shown and described in detail to illustrate the inventive principles, it will be understood that the invention may be embodied otherwise without departing from such principles.

What is claimed is:

1. A lighting unit for water fountains, ponds and the like, the lighting unit comprising:

a housing sealed at least relative to splashing water;

a light source arranged in the housing;

a lens, having a first optical axis, arranged in the housing and aligning light emitted by the light source relative to the first optical axis:

an additional lens unit, having a second optical axis, arranged in a light path of the light emitted by the light source and providing an additional alignment of the light emitted by the light source relative to the second optical axis;

a closure cap securing the additional lens unit by a self-centering action on the housing and positioning the second optical axis so as to coincide with the first optical axis;

wherein the closure cap has an inner guide at an end proximal to the additional lens unit which inner guide provides the self-centering action;

wherein the inner guide has a surface that tapers in a direction of the first and second optical axes toward the first and second optical axes.

2. The lighting unit according to claim 1, wherein the lens unit has a contact area that is at least partially complementary to the surface.

3. The lighting unit according to claim 1, further comprising a seal interacting with the surface of the inner guide for centering the lens unit and for sealing the housing.

4. The lighting unit according to claim 1, wherein the closure cap secures the lens through the lens unit.

5. The lighting unit according to claim 1, wherein the closure cap and the lens unit each have a width that is less than or identical to a maximum cross-sectional width of the lighting unit.

6. The lighting unit according to claim 1, wherein the lens unit is arranged downstream of the lens in the light path.

7. The lighting unit according to claim 1, wherein the lens unit is an additional lens.

8. The lighting unit according to claim 7, wherein the additional lens is a thin lens.

9. The lighting unit according to claim 7, wherein the light source is arranged at a spacing to a focal plane of the additional lens, wherein the spacing matches at least a focal length of the additional lens.

10. The lighting unit according to claim 1, wherein the light source is a multi-color LED.

11. The lighting unit according to claim 1, wherein the closure cap and the housing are at least substantially of a cylindrical shape and adapted to be centered additionally in a holder.

12. The lighting unit according to claim 11, wherein an outer contact area is provided as an additional centering means which contact area comprises at least one O-ring.

13. The lighting unit according to claim 1, wherein the lighting unit has a preferably circumferentially extending groove for mounting the lighting unit.

14. The lighting unit according to claim 1, further comprising a cable screw connection at an end of the housing opposite the closure cap.

15. The lighting unit according to claim 1, wherein the housing is comprised of three parts.

* * * * *